United States Patent [19]

Perr et al.

[11] Patent Number: 4,909,219

[45] Date of Patent: Mar. 20, 1990

[54] HYDROMECHANICAL FUEL PUMP SYSTEM

[75] Inventors: Julius P. Perr; Lester L. Peters, both of Columbus; Edward D. Smith, Greensburg, all of Ind.

[73] Assignee: Cummins Engine Company, Inc., Columbus, Ind.

[21] Appl. No.: 298,911

[22] Filed: Jan. 19, 1989

[51] Int. Cl.[4] ..... F02M 39/00

[52] U.S. Cl. ..... 123/456; 123/387

[58] Field of Search ..... 123/446, 447, 502, 387, 123/386, 385, 456; 239/88-96

[56] References Cited

U.S. PATENT DOCUMENTS

| | | | |
|---|---|---|---|
| 3,026,565 | 5/1962 | Reiners | 123/456 |
| 3,443,554 | 5/1969 | Kleeberger | 123/387 |
| 3,908,621 | 9/1975 | Hussey | 123/456 |
| 3,927,654 | 12/1975 | Perr | 123/387 |
| 3,968,779 | 7/1976 | Davis | 123/387 |
| 4,041,920 | 8/1977 | Skinner | 123/446 |
| 4,235,374 | 11/1980 | Walter | 123/456 |
| 4,301,777 | 11/1981 | Grundman | 123/387 |
| 4,328,778 | 5/1982 | Huperz | 123/387 |
| 4,721,247 | 1/1988 | Perr | 239/91 |

FOREIGN PATENT DOCUMENTS

| | | | |
|---|---|---|---|
| 646967 | 8/1962 | Canada | 123/456 |
| 264418 | 10/1949 | Switzerland | 123/456 |

OTHER PUBLICATIONS

The Oil Engine and Gas Turbine, "New Pressure-Time Fuel System: Cummins Layout of the Latest Form", Apr., 1961.

*Primary Examiner*—Carl Stuart Miller

*Attorney, Agent, or Firm*—Sixbey, Friedman, Leedom & Ferguson

[57] ABSTRACT

A hydromechanical fuel pump system of supplying timing fluid and fuel to high pressure fuel injectors utilizing a hydromechanical fuel control circuit to control the flow of fuel that is withdrawn from a fuel reservoir by a pump and delivered to the fuel injectors which includes a speed signal generator that produces a fuel pressure in a speed signal branch line of the fuel control circuit that is a function of engine rpm, and a torque shaping module that is provided in a fuel delivery branch of the fuel control circuit. The torque shaping module controls the supply pressure of the fuel flow to the injectors so that, during an initial engine operating range, the supply pressure is merely that as received from the fuel pump, in a second engine operating range, the torque shaping module causes the supply pressure to be a function of fuel pressure in the speed signal branch line as boosted by an assist means, the effect of which is removed in a third engine operating range, and in a last engine operating range, the supply pressure is determined by partially offsetting the effect of the pressure in the speed signal branch line by a counterpressure factor.

29 Claims, 12 Drawing Sheets

HYDROMECHANICAL FUEL PUMP SYSTEM

BACKGROUND OF THE INVENTION

1. Field of the Invention

The present invention relates to hydromechanical fuel pump systems for supplying timing fluid and fuel to high pressure fuel injectors. In particular, to such a system for supplying the timing fluid and fuel to an injector at a controlled pressure which may be adjusted in accordance with engine operating conditions.

2. Description of Related Art

In U.S. Pat. No. 4,721,247, issued to one of the present co-inventors, a high pressure unit fuel injector is disclosed which is designed to inject precisely metered quantities of fuel at a timing that is controllable as a function of the amount of timing fluid supplied to a variable timing fluid chamber. In such an injector, the amount of timing fluid and the amount of fuel to be injected are a function of the pressure of the fuel supplied to the injection chamber and used as a timing fluid in the timing chamber. If only pressure affects the quantity metered, the system is "P" metered. If the time period during which fuel is supplied also affects the quantity metered, the Such injectors are known as "PT" injectors. Other examples of such unit fuel injectors are identified in the Background Art portion of U.S. Pat. No. 4,721,247, as well.

As can be appreciated, the effectiveness of high pressure fuel injectors of the "P" or "PT" type is dependent on the effectiveness of the fuel supply system used for supplying the timing fluid and the fuel to be injected. In FIG. 3 of U.S. Pat. No. 4,721,247, an electronically controlled fuel supply system for such fuel injectors is diagrammatically depicted. This system utilizes an electronic control unit for monitoring throttle position and the output of sensors measuring such factors as engine temperature and the like to operate an electronically controlled fuel supply valve arrangement that regulates the supplying of fuel to supply rails associated with a plurality of injectors of an engine and also controls the pressure of the fluid in the timing rail that supplies timing fluid to the timing chambers of the injectors. However, electronic controls are expensive, require expensive equipment to service and may require m ore service than an equivalent hydromechanical control.

Hydromechanical controls for fuel injection systems, including those of the "PT" type, are known. For example, in FIG. 1, a prior art "PT" governor is illustrated which may be used to control presure and thereby the quantity of fuel supplied to fuel injectors as a function of engine rpm in its function as a governor for setting the idle speed and maximum speed of operation of a fuel injected engine with which it is associated. In particular, this known governor utilizes a flyweight arrangement consisting of governor weights that are pivotally carried by a weight carrier that is spring biased by weight assist and torque springs. The weight carrier is caused to rotate at a rpm corresponding to that of the engine so that as engine speed increases, the rotational speed of the weight carrier increases. As a result, the governor weights pivot under the effects of centrifugal force and thereby cause axial displacement of a shaft received within a governor sleeve of a governor barrel This axial displacement controls flow between a supply port, by which fuel is received by the governor, and idle, fuel out, and bypass ports. Flow from the shaft to the bypass port is controlled by a pressure control button that is acted upon by an idle spring and which is received within a button guide that is biased by a governor spring.

By balancing the force supplied by the idle spring on the pressure control button relative to the biased flyweight force applied at the desired low idle speed, the engine idle speed can be controlled. Similarly, by balancing the force of the governor spring against the biased flyweight force applied by the governor weights at the desired maximum engine speed. The maximum speed can he controlled. Fuel is constantly bypassed to maintain the proper fuel supply pressure between idle and maximum speeds. However, such a "PT" governor does not have any means for providing a separate, i.e., independent, speed signal which may be used, for example, for controlling timing pressure as a function of speed. Furthermore, since torque shaping, via the weight assist and torque springs, is integrated into the speed governor, separate controlling of the individual functions of torque shaping and governing is not very easy. Thus, there is a need for a hydromechanical control arrangement which will enable easier control of the individual torque shaping and governing functions, while at the same time providing a speed signal that may be utilized as a engine speed parameter for control of the pressure of the timing fluid supply.

SUMMARY OF THE INVENTION

In view of the foregoing, it is a general object of the present invention to provide a hydromechanical fuel pump system for supplying timing fluid and fuel to high pressure fuel injectors wherein the torque shaping function is performed by a torque shaping module that is separate from the governor of the pump system for easier control of these two functions.

A second object of this invention is to provide a hydromechanical fuel pump system for supplying timing fluid and fuel to high pressure fuel injectors wherein a speed signal is provided for controlling both torque shaping and timing fluid pressure as a function of engine rpm.

It is a further object of the present invention to he readily adaptable to a variety of timing pressure control strategies, such as, continuously as a function of speed only, stepwise as a function of speed and load, and continuously as a function of speed and load.

It is another object, in keeping with the preceding object, to enable a variety of timing strategies to be implemented expeditiously, with the same basic construction of the fueling portion of the pump system that provides the fuel to be injected by the fuel injectors into an engine.

The above described objects of the present invention are achieved, along with others, by preferred embodiments of the hydromechanical fuel pump system in accordance with the present invention that are comprised of a pump for withdrawing fuel from a reservoir and delivering the fuel under pressure to a fuel line and a hydromechanical fuel control circuit arrangement for interconnecting the fuel line to injector fuel supply rails for controlling the flow of fuel to the injectors, wherein a speed signal generating means is provided for producing a fuel pressure in a speed signal branch line of the fuel control circuit that is a function of engine rpm squared, and w herein a torque shaping module is provided in a fuel delivery branch of the fuel control circuit that has a means for receiving fuel flow from the fuel line and supplying it on through the fuel delivery branch line at a supply pressure corresponding to that required for proper engine torque at each engine operating range.

The speed signal generator means is advantageously formed of a flyweight arrangement that produces a force that varies as a function of engine rpm squared and a button pop-off means that opens so as to allow fuel to pass from the speed signal branch line to the fuel reservoir for regulating the fuel pressure in the speed signal branch line as a function of a ratio of the flyweight force relative to an area of the button pop-off valve means that is acted upon by fuel in the speed signal branch line. Additionally, this speed signal generator may be integrated into a single module with a speed governor that can be designed as either a maximum-minimum engine speed governor or as an all speed governor.

Additionally, in accordance with the preferred embodiments, a timing fluid supply means, including a timing fluid supply branch line that is connected to the fuel line for delivering fuel from the pump to the injection timing chambers of the injectors, is provided that may operate to regulate the timing fluid supply in differing modes. That is, in a first version, timing pressure is regulated continuously as a function of engine speed only, while in a second version a stepwise control is achieved as a function of engine speed and engine load. Still further, in accordance with a third version, the timing pressure control strategy produces a continuous regulation of timing fluid pressure as a function of both engine speed and engine load. In the first case, no special provisions need to be made beyond the inclusion of a spring-biased piston regulator valve in the fuel delivery branch. On the other hand, for the second and third versions, a timing signal pressure generator module is provided that is responsive to fuel pressure in the speed signal branch line and to fuel pressure in the fuel supply rails to the injectors for producing a pilot pressure in a pilot line that is function of engine speed and engine load, and a timing pressure regulator is provided in a timing fluid supply branch line that is responsive to the pilot pressure in the pilot line for adjusting timing fluid flow from the timing fluid supply branch line to the injectors.

These and further objects, features and advantages of the present invention will become more apparent from the following description when taken in connection with the accompanying drawings which show, for purposes of illustration only, several embodiments in accordance with present invention.

DETAILED DESCRIPTION OF THE PREFERRED EMBODIMENTS

Figure 1:
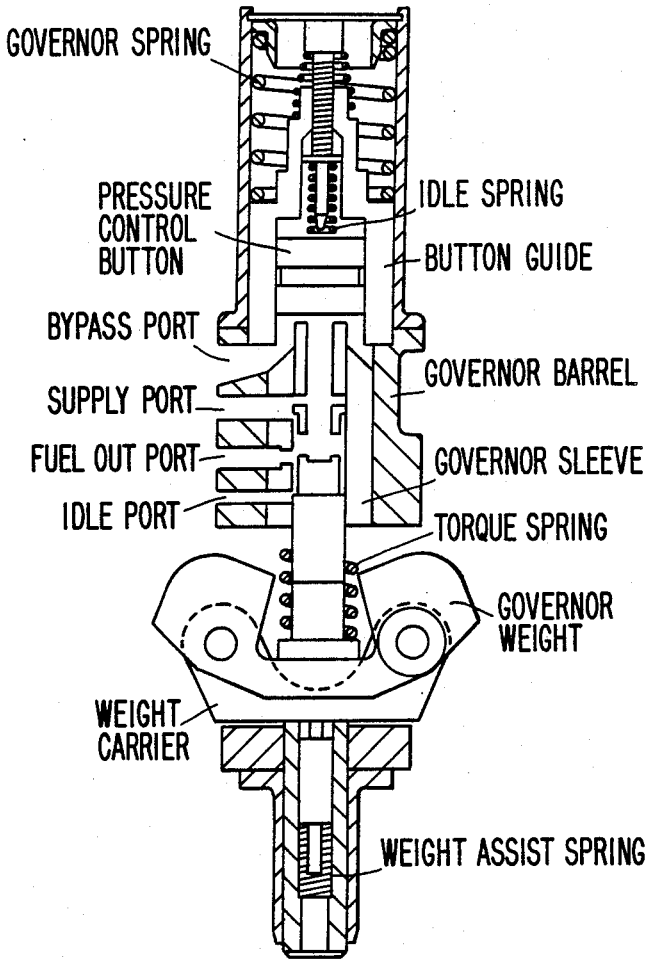
FIG. 1. (PRIOR ART)
FIG. 1 is a partial sectional view of a prior art "PT" governor.
Figure 2:
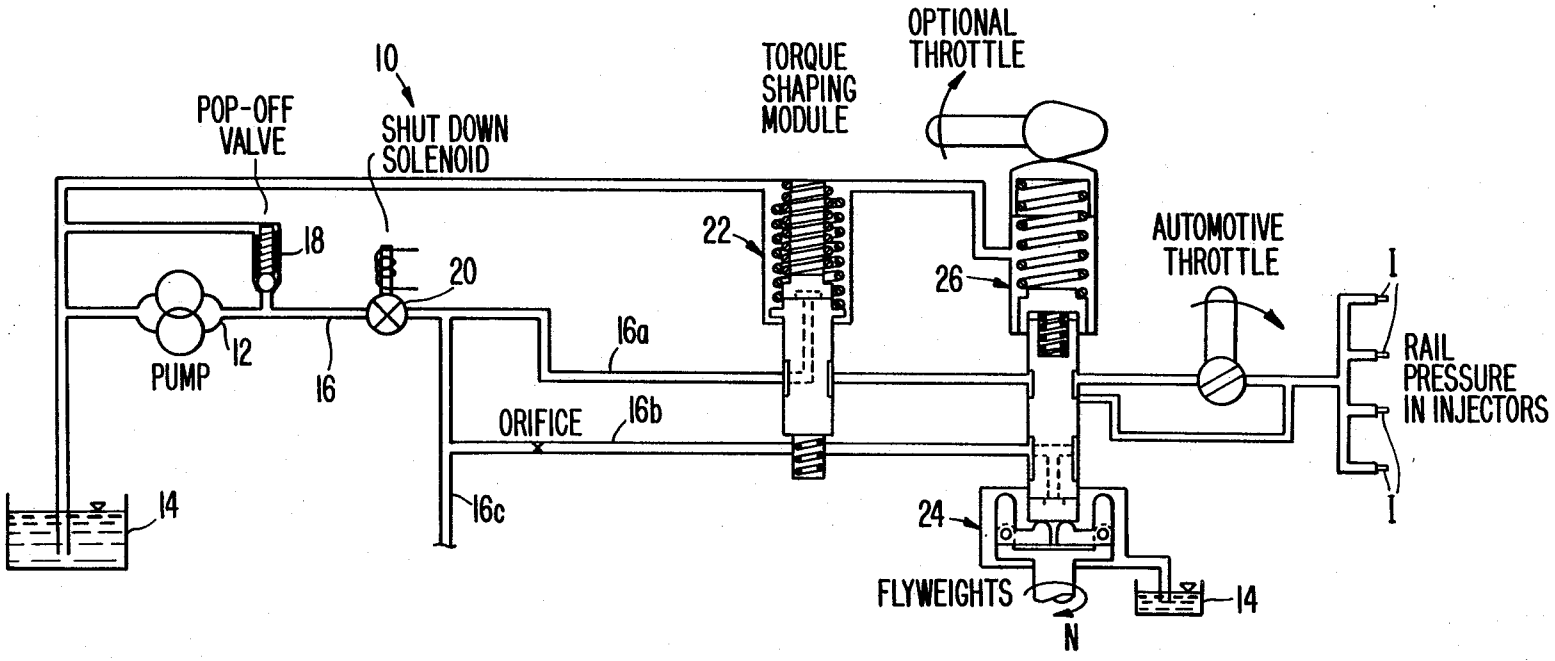
FIG. 2 is a diagrammatic illustration of the fuel supply side of a hydromechanical fuel pump system in accordance with the preferred embodiment of the present invention.

FIG. 2 diagrammatically illustrates a basic hydromechanical fuel pump system 10 for supplying timing fluid and fuel to high pressure fuel injectors I, and will be utilized to describe those aspects common to all of the disclosed embodiments of the present invention and specifically, the means by which the circuit controls the delivery of fuel to the injectors I for injection into the cylinder of an internal combustion engine, such as a diesel engine. As illustrated, the pump 12, which may be any form of positive displacement pump, such as a gear pump, vane pump, "gerotor" or the like. Pump 12 serves for withdrawing fuel from a fuel reservoir 14, such as the fuel tank of an highway vehicle, and delivering the fuel at a maximum pressure of approximately 250 psi to a fuel line 16. Downstream of the pump 12, in the fuel line 16, is a pop-off valve 18 and a shut-down solenoid 20. The solenoid 20 shuts off the fuel supply to the injectors when the system is shut down, and the pop-off valve 18 serves as a relief valve to avoid excessive pressure build-up when the fuel supply is shut off by the solenoid 20. From solenoid 20, fuel from the pump 12 travels, via a fuel delivery branch **16*a* of fuel line 16 into the fuel control circuit portion of the system 10. The fuel control circuit portion is comprised of a torque shaping module 22, a speed signal generator designated 24, and an engine speed governor designated generally by the reference number 26**, and serves the purpose of controlling the flow of fuel to the fuel supply rails of the injector I.

Figure 3:
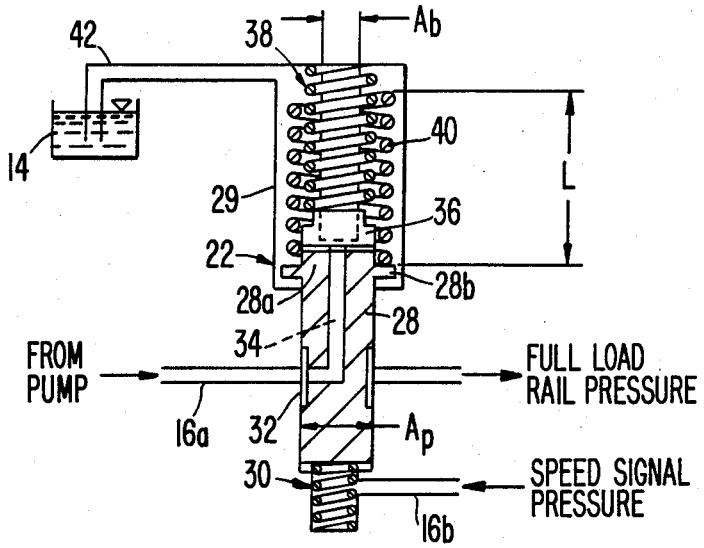
FIG. 3 is a diagrammatic illustration of the torque shaping module shown in FIG. 2.
Figure 4:
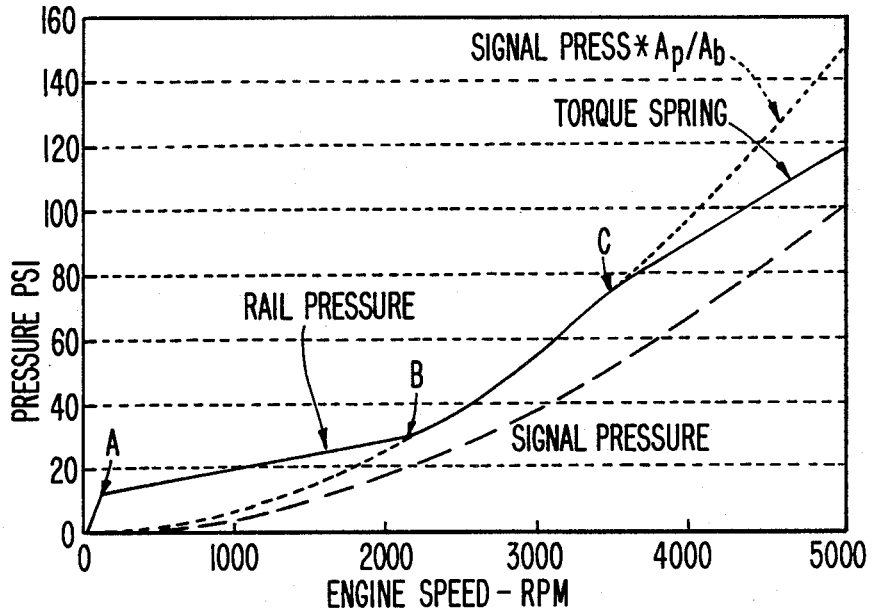
FIG. 4 is a graph of the performance of the torque shaping module in shaping fuel pressure in response to increasing engine speed.

With reference to FIGS. 3 and 4, the nature and function of the torque shaping module 22 will now be described. The torque shaping module 22 is interposed in the fuel delivery branch **16*a* and is comprised of a plunger 28 that is axially displaceable within the housing 29 of the module by an assist spring 30. A peripheral flow channel 32 surrounds plunger 28 and may be formed directly in its periphery, as shown, or may be formed in the facing surface of the peripheral wall of the housing 29. A fuel bypass passage 34 extends from the peripheral flow channel 32 surrounding plunger 28 to the end of the plunger 28***a*. A valve means in the form of a button closure member 36 and a pressure spring 38 are provided for closing the outlet end of provided with a peripheral flange 28*b*, upon which a torque control spring 40 fits. Lastly, a fuel return line 42 interconnects the upper end of housing 29 of the torque shaping module 22 with the fuel reservoir 14.

With the aid of FIG. 4, the operation of torque shaping module 22 will now be explained. As can be appreciated, the speed signal pressure to which the bottom end of plunger 28 is exposed is applied over the plunger area $A_p$ together with the force of the weight assist spring 30, while a force is applied to plunger end 28*a* by the button closure member 36 under the action of the pressure spring 38 which is applied to a button area $A_b$. The preload of the pressure spring against the assist spring 30 generates the minimum pressure required to unseat the button closure member 36. As speed signal pressure is inceased, the load on pressure spring 38 increases because plunger 28 is moving. The contribution of assist spring 30 decreases until the plunger 28 moves far enough to become unseated from the assist spring. Once the plunger 28 is unseated, the supply pressure through fuel delivery branch 16*a* will be regulated at a pressure which is a multiple of the speed signal pressure. This multiple is equal to the ratio of the plunger area $A_p$ and the button area $A_b$. Furthermore, after a given amount of travel of the torque shaping plunger 28, the torque spring, which has been at its fully extended free length, L, contacts the upper end of housing 29 and begins to be compressed, thereby partially counteracting the speed signal effect.

In terms of the pressure values produced as engine speed (rpm) increases, it can be seen that, initially, up to a point A, button closure member 34 is seated so that the rail pressure transmitted on to the injectors is equal to the full load delivered by the pump to the torque shaping module. Until the plunger 28 has travelled far enough to unseat itself from the assist spring 30 (which occurs at point B), the combined effect of the pressure spring 38, assist spring 30, and speed signal pressure SP will be greater than the speed signal pressure multiplied by $A_p/A_b$ so that the rail pressure will rise slowly as a result of the decreasing effect of assist spring 30, as it expands with continued plunger travel, which increases the pressure necessary to unseat button member 34. On the other hand, once the plunger has unseated itself from the assist spring 30, the rail pressure will rise more rapidly in accordance with the relationship $A_p/A_b$ multiplied by SP since the button closure member 34 will unseat itself from the plunger end 28*a* whenever the supply pressure in fuel delivery branch 16*a* exceeds a pressure value corresponding to the speed signal pressure multiplied by the ratio $A_p/A_b$, with the result that fuel is caused to circulate back to the fuel reservoir from the branch line 16*a* via the fuel return line 42. Once the torque control spring 40 comes into play, at point C, it counteracts the effect of the speed signal pressure and thereby lowers the pressure necessary to unseat the button closure member 34 to allow fuel to be bypassed back to the fuel reservoir via the return line 42.

Thus, as reflected in FIG. 4, initially, the supply pressure in the branch line 16*a* downstream of the torque shaping module 22 will be equal to that upstream of the module 22 and then will be governed by the force of the speed signal pressure acting against $A_p$ plus the force of assist spring 30, this pressure increasing slowly with increasing engine speed, during a low speed engine operation range. In a middle speed range, the supply pressure is regulated as a function of the rpm squared along the line dictated by the speed signal pressure multiplied by the ratio of the areas $A_p/A_b$. Finally, in the high speed operation range, where the torque spring comes into play, the pressure is regulated to increase at a lesser rate than that dictated by the speed signal pressure. As a result, it should be appreciated that the torque shaping module 22 allows a high degree of freedom in shaping the maximum fueling curve through changing of any of the components of button area Ab, pressure spring rate and preload, weight assist spring installed length and rate, and torque spring free length and rate.

Figure 5:
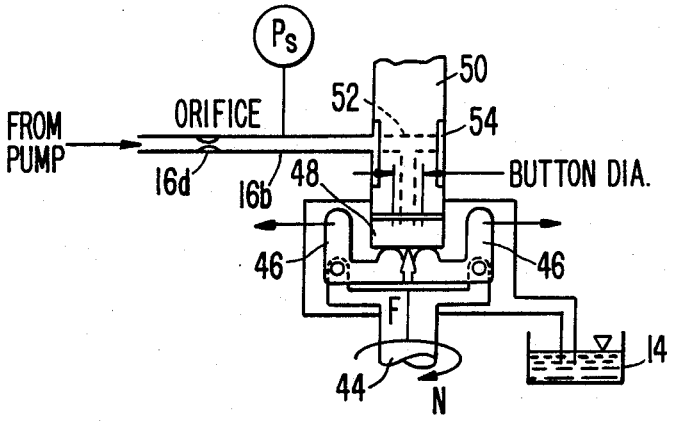
FIG. 5 is a diagrammatic illustration of the speed signal generator illustrated in FIG. 2.

The speed signal pressure is produced in the speed signal branch line 16*b* by the speed signal generator 24 so as to provide a pressure that changes as a function of the engine rpm squared in order to obtain a fixed quantity of fuel per cycle, as the rpm changes, in accordance with the standard PT fuel system metering characteristics. To this end, the speed signal generator 24 is comprised of a rotary weight carrier, the rotational speed of which increases and decreases with engine speed. Pivotally mounted to the rotary weight carrier 44 are a plurality of substantially L-shaped flyweights. As engine speed increases, the rate of rotation of the weight carrier 44 increases, and the resultant increase i n centrifugal force, in the direction of the arrows shown in FIG. 5, acts to pivot the weights so as to produce an axially directed force F that is a function of engine rpm squared. This force is directed so as to act on a flat button pop-off valve 8. The button pop-off valve 48 seats against the end of an axially displaceable shaft 50 so as to seal the end of a fuel bleed passage 52 that is formed in the shaft 50 and communicates with the speed signal branch line 16*b* via a peripheral flow channel 54 surrounding the shaft 50.

Figure 6:
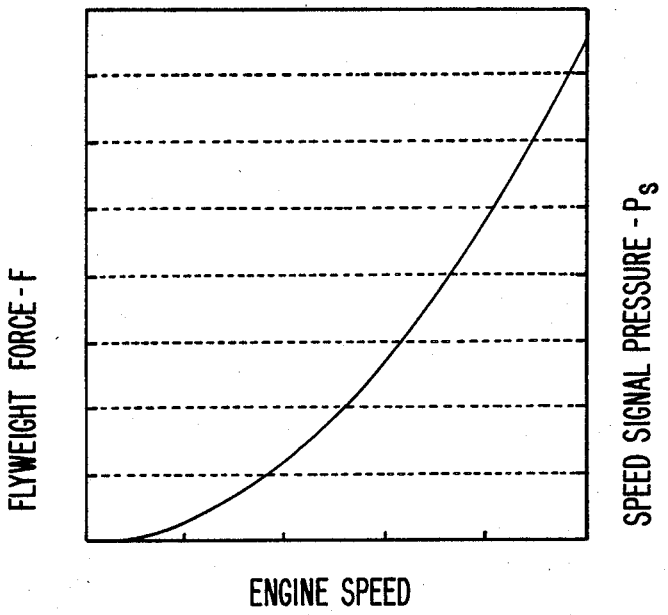
FIG. 6 is a graph depicting the relationship between flyweight force and speed signal pressure relative to engine speed for the speed signal generator of FIG. 5.

Thus, whenever the pressure $P_s$ of the fuel within the speed signal branch line 16*b* exceeds the force F applied by the flyweights 46 divided by the area of the button diameter against which the force F is applied, the button diameter being that to which the pressure Ps is applied, the button pop-off valve 48 will be able to overcome the centrigual force on the flyweights 46, thereby causing them to pivot in the opposite direction of the arrows shown and unseat itself from the end of the shaft 50. As a result, fuel is, then, permitted to bleed off from the speed signal branch line 16*b* to the fuel reservoir 14, thereby lowering the pressure $P_s$ in the branch line 16*b* until such time as it is low enough to cause the force F to reseat the button pop-off valve 48. Accordingly, the speed signal pressure $P_s$ is able to maintain the relationship with respect to engine speed shown in the graph of FIG. 6. The connection of speed signal branch line 16*b* to the fuel line 16 via orifice 16*d* allows fuel bled off to be replaced, while allowing the pressure in branch line 16*b* downstream of orifice 16*d* to differ from that upstream thereof sufficiently to allow the pressure therein to be dictated by the speed signal generator 24.

Figure 7:
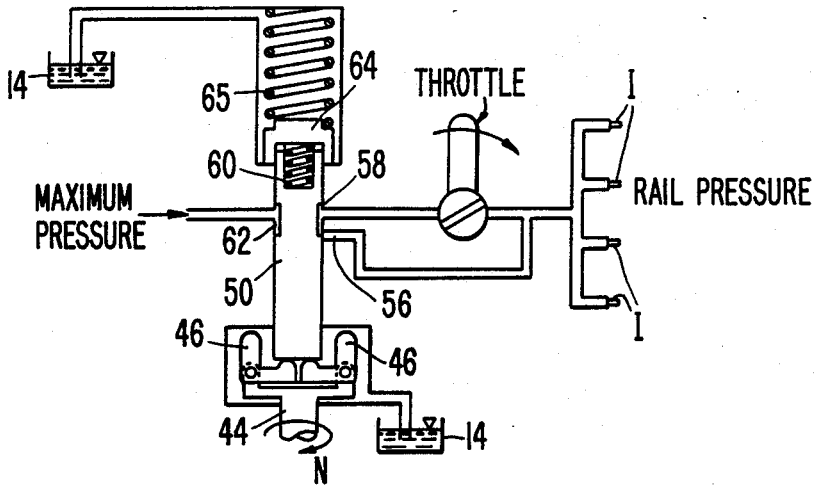
FIGS. 7 and 8 illustrate, respectively, a maximum-minimum speed governor and all-speed governor for use, alternatively, in the FIG. 2 embodiment.

In accordance with the invention, the above described speed signal generator is integrated into either an all speed governor or a minimum-maximum governor used to control the minimum (idle) engine speed and maximum engine speed. FIG. 7 illustrates a minimum-maximum type governor, while FIG. 8 illustrates an all speed governor which utilize the axially displaceable shaft 50 and an arrangement of flyweights 46 on a flyweight carrier 44 of the speed signal generator 24 to restrict either a low idle 56 or high speed port 58 in the case of the minimum-maximum type governor, or only the port 58 (port 56 being inactive) in the case of the all speed governor.

In the minimum-maximum type governor, the low idle port 56 bypasses the fuel supply throttle, and will set the engine idle speed when the throttle is closed. This is done by balancing the force applied by the flyweights 46 against the force applied by a low idle spring 60 to enable low idle port 56 to communicate with the fuel delivery branch via a peripheral groove 62. If, under closed throttle, idle conditions engine speed should increase above the desired idle level, shaft 50 will be shifted due by the flyweight force so as to compress the low idle spring 60, thereby restricting the low idle port 56, and resulting in a reduction in fuel to the engine and lowering of its operating speed back to the desired idle speed.

On the other hand, as the throttle is opened, engine speed will be able to increase, despite closing off of the low speed port due to the axial displacement of the shaft 50 caused by the effect of the flyweights, until the shaft bottoms in a guide cap 64 that is seated on the upper end of the shaft 50 and against which a high speed spring 65 is engaged. Once the maximum desired engine speed is achieved, the flyweight force will be sufficient to compress the high speed spring 65, thereby bringing about a restriction in the fuel supply permitted to pass through the high speed port 58 as the peripheral groove 62 then begins to move upwardly passed the high speed port 58. FIG. 7 illustrates the positioning of the peripheral groove 54 relative to the low idle port for bringing about a restriction of flow thereto during closed throttle, engine idling conditions. A similar relationship will be exist between the peripheral groove 62 and the high speed port during regulation of fuel flow to obtain the desired maximum speed.

Figure 8:
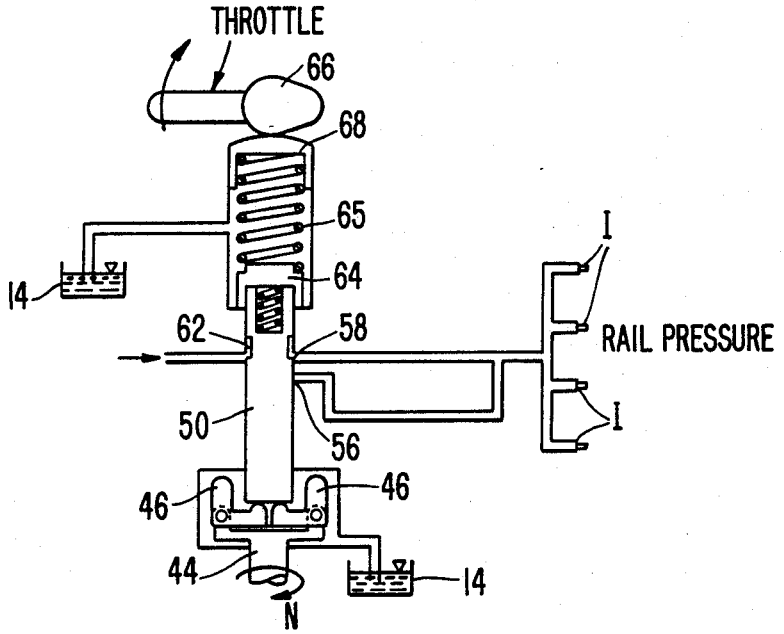

As show n in FIG. 8, the same arrangement described relative to the maximum-minimum governor of FIG. 7 can be converted into an all-speed governor by removing the normal throttle shown in FIG. 7 and adding a throttle which controls the spring force via a cam lobe 66 that is carried by the throttle m ember and engages a displaceable follower cap 68 that is seated on top of the high speed spring 65. In this way, engine speed is controlled by balancing of the flyweight force F relative to the spring force set by the throttle cam lobe 66 due to the progressive compression of the springs 60, 65 brought about thereby. All engine speeds are governed using only port 58.

Having fully described the basic construction of the hydromechanical fuel pump system of the present invention and the manner in which it may be utilized to control the delivery of fuel to the injectors I for injection into an engine, three preferred constructions using this system for controlling the supply of timing fluid to the injectors will now be described with reference to FIGS. 9–14.

Figure 9:
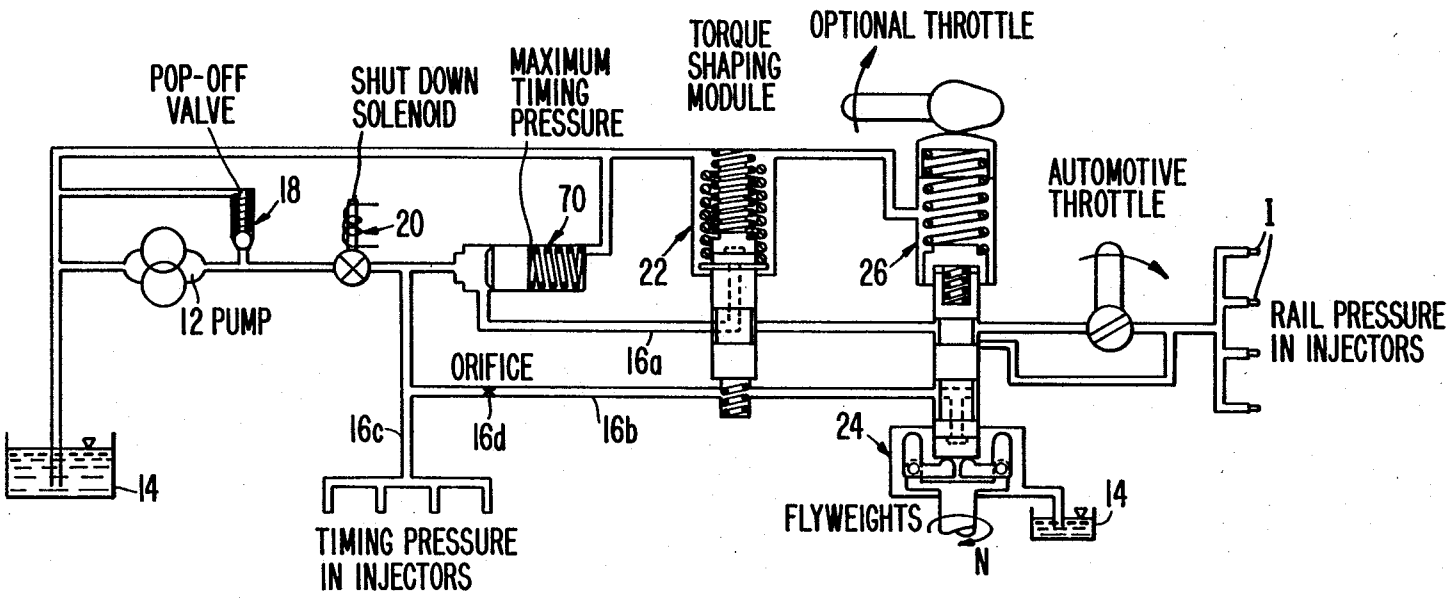
FIGS. 9 and 10 are a diagrammatic illustration of the hydromechanical fuel pump system of FIG. 2 with the addition of a timing side that continuously adjusts timing pressure as a function of engine speed, and a graph depicting the timing pressure control characteristics thereof, respectively.
Figure 10:
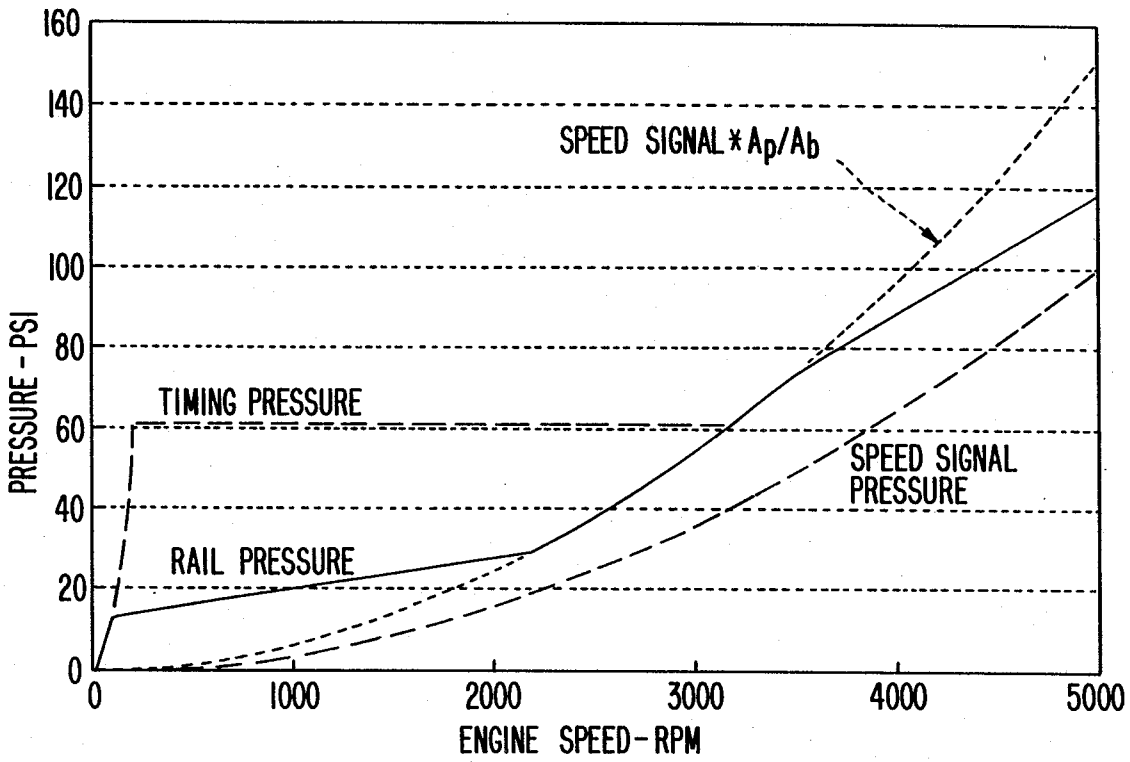

FIG. 9 illustrates the simplest of the preferred fuel pump control versions and serves for supplying timing fluid to the injectors at a pressure that varies continuously as a function of engine speed. In this case, the timing fluid rails of the injector are connected directly to the timing fluid supply branch line **16*c* and a spring-biased piston regulator valve 70 is disposed in the fuel delivery branch 16*a* as a means for maintaining a minimum timing fluid pressure in the timing fluid supply branch line 16*c*. In particular, at low engine speeds, the timing pressure is set by the spring force in the minimum timing pressure regulator valve 70. However, as the engine speed increases, the maximum supply pressure in line 16*a* will increase and once the supply pressure is equal to the minimum timing pressure, the regulator valve 70 will cease to have any effect and the timing pressure will then follow the supply pressure as it increases. Thus, this version provides a constant timing pressure at low engine speeds and one that is the same as full load rail pressure, which increases as a function of engine speed thereafter in the manner depicted on the graph of FIG. 10**. This system relies on the natural retarding of the start of injection as load decreases of the basic "PT" fuel system and additional timing controls are possible by changing the size of the timing feed ports and timing springs in the particular injector itself.

Figure 11:
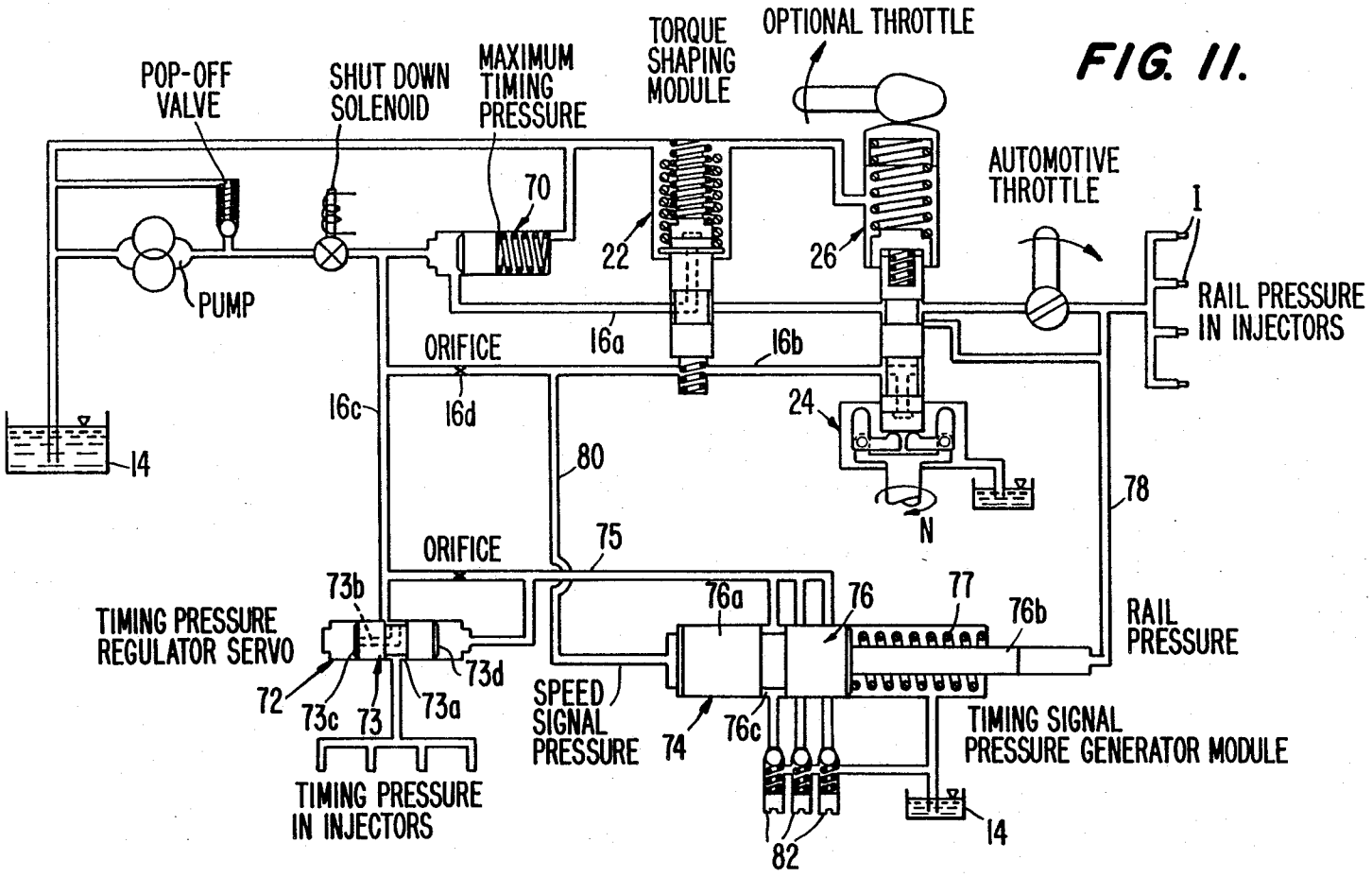
FIGS. 11 and 12 illustrate a hydromechanical fuel pump and graph similar to those of FIGS. 9 and 10, but for a hydromechanical fuel pump wherein timing pressure is adjusted stepwise as a function of both engine speed and load.

FIG. 11 illustrates a second version of the hydromechanical timing control aspect of the pump system of the present invention that is designed to produce a stepwise adjustment of timing pressure as a function of engine speed and load. In this embodiment, the regulator valve 70 serves as a maximum timing pressure regulator instead of a minimum one, and a timing pressure regulator servo 72 is provided in the timing fluid supply branch line **16*c* for setting the pressure of the timing fluid, delivered via the timing fluid rails to the timing chambers of the fuel injectors, by restricting flow through the timing fluid supply branch line 16*c*. The timing pressure regulator servo 72 is responsive to a pilot pressure developed by a timing signal pressure generator module 74 to which the timing pressure regulator servo is exposed via a pilot line 75. The timing pressure regulator servo 72 has a control piston 73 that is provided with a peripheral groove 73*a* which allows fluid to flow around the control piston 73 and on to the fuel injectors. Pressure in line 16*c* is restricted at the inlet to groove 73*a*. Piston 73 also has a passage 73*b* through which fluid can flow from the peripheral groove 73*a* through and out of one end 73*c* of piston 73 (the left in FIG. 11) to expose that end of the piston to the pressure supplied to the timing port in the fuel injectors which is equal to or lower than the pressure in timing fluid supply branch line 16*c*. The opposite end 73*d* of the control piston 73 (the right end in FIG. 11) is connected to the pilot line 75 so as to expose it to the pressure within the pilot line 75**.

Thus, when the pilot pressure in the pilot line 75 is greater than the timing fluid pressure to the fuel injectors, control piston 73 is cause to shift to the left increasing timing fluid fuel supply. On the other hand, while if the pilot pressure drops below that of the timing fluid to the fuel injectors, the control piston 73 is shifted in a manner restricting flow through the timing pressure regulator servo 72, thereby effectuating an opposite regulating of the timing fluid supply. As is the case with respect to the speed signal branch line **16*b*, the pilot line 75 is connected to the timing fluid supply branch line 16*c* via an interposed orifice which has the effect of allowing the pressure in the pilot line to increase and decrease sufficiently independently of the pressure in timing fluid supply branch line 16*c*** to allow the described control functions to be carried out.

As noted, the pilot pressure in pilot line 75 is dictated by a timing signal pressure generator module 74. This module is a servo-mechanism with a slide member 76 having a large diameter portion **76*a***, a small diameter 76*b* and a peripheral recess 76*c* that is formed in the surface of the large diameter portion 76*a*. A return spring 77 is positioned about the small diameter portion 76*b* and its force is added to the force acting on the end of the small diameter portion 76*b* by its exposure to the fuel pressure in the fuel supply rails of the fuel injectors I, and is communicated thereto by the fuel supply pressure timing branch 78. This force acts to produce movement of slide member 76 to the illustrated position. Movement of the slide member 76 in an opposite direction (i.e., to the right in FIG. 11) is achieved when the speed signal pressure, which is communicated to the opposite end of the slide member 76 from the small diameter portion 76*b* via a speed signal timing branch line 80, becomes sufficiently great. Control over these movements can be achieved by selection of the ratio of the areas of the end faces of the slide member 76 and the spring force produced by the return spring 77.

Figure 12:
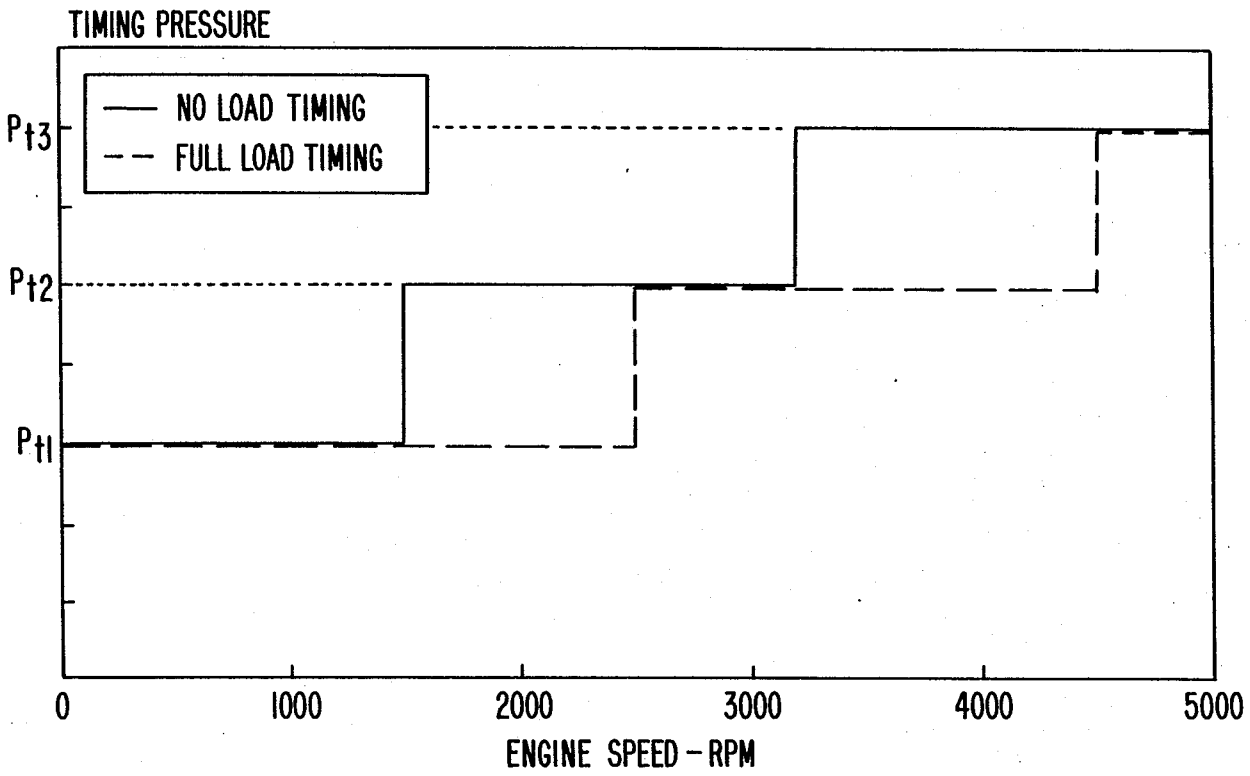

To achieve variation of the pilot pressure, a plurality of pressure regulator valves 82 are provided, each of which opens at a different pressure, $P_{T1}$, $P_{T2}$, and $P_{T3}$, so as to allow a small quantity of fuel to flow therethrough to the fuel reservoir 14 from the pilot line 75. These pressure regulator valves 82 are placed in communication with the peripheral recess 76*c* on an individual basis, dependent on the position of the slide member 76 as determined by the net effect of the fuel pressures to which its opposite ends are exposed together with the effect of the return spring 77. Thus, a stepwise adjustment of the timing fluid pressure is achieved as a function of both engine speed and engine load, as reflected by the changes in speed signal pressure and supply rail pressure. Furthermore, the number of steps produced is merely a function of the number of pressure regulator valves 82 incorporated into the timing signal pressure generator module, three steps being sufficient for a heavy duty diesel engine. In FIG. 12, an example of the timing pressure control effectuated under no load timing and full load timing conditions is shown for the embodiment illustrated in FIG. 11.

Figure 13:
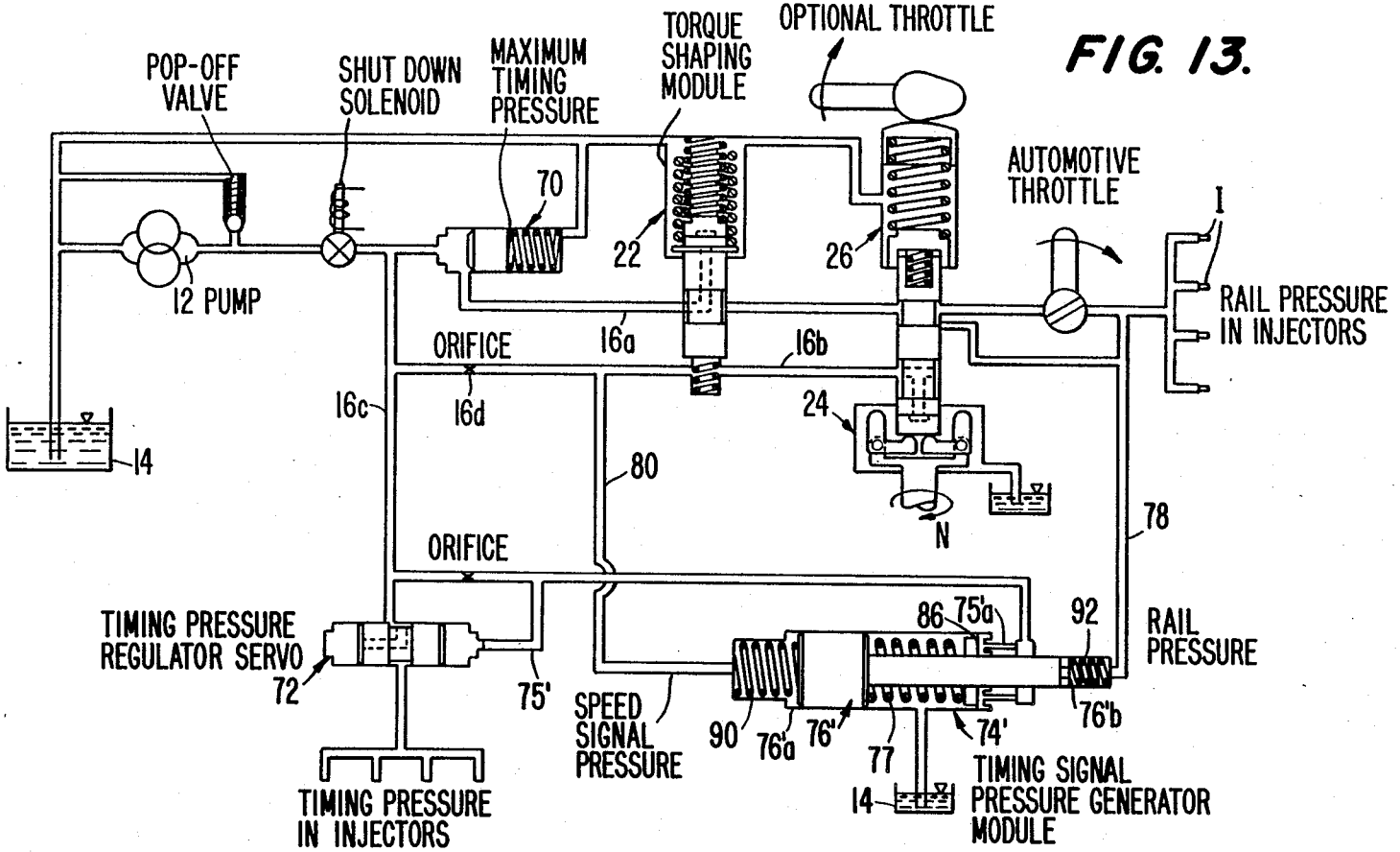
FIGS. 13 and 14 are a diagrammatic illustration and graph similar to those of FIGS. 9 and 10, but of a hydromechanical fuel pump system wherein timing pressure is adjusted continuously as a function of speed and load.
Figure 14:
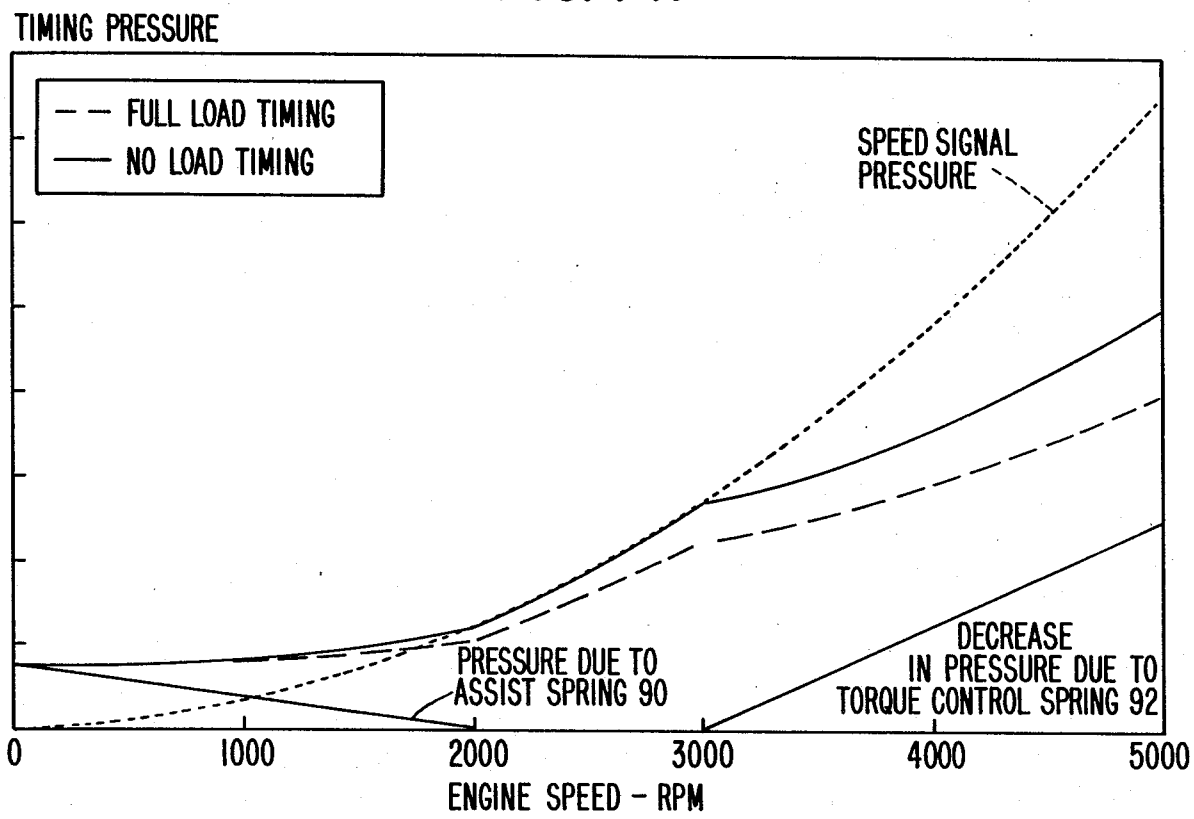

FIG. 13 shows a modification to the embodiment of FIG. 11 which enables the change in timing fluid pressure as a function of both speed and load to be achieved in a continuous manner. This embodiment is constructed and operates, from a hydromechanical standpoint, in essentially the same way as the embodiment of FIG. 11, except that, to achieve a continuous pressure regulation, the timing signal pressure generator module 74′ is modified relative to that of FIG. 11 in that the slide member 76′ merely has a large diameter and small diameter portion 76′*a*, 76′*b* and pressure regulation is achieved by a single pressure regulator valve 86. Regulator valve 86 is disposed about the small diameter portion 76′*b* of the slide member 76′ and is biased into a position closing ports 75′a which communicate with the interior of the timing signal pressure generator module 74′ and with the pilot line 75′. As a result, a small quantity of fuel is bled out of the pilot line 75′ whenever the pressure in the pilot line times the total area of ports 75′*a* exceeds the force applied to the pressure regulator valve 86 by the spring 77. Furthermore, the pressure applied by the spring 77 increases and decreases continuously with the compression and expansion thereof that is produced by shifting of the slide member 76′ to the right and left relative thereto. Also provided within the modules 74′ are balance springs 90, 92 which act on the large and small diameter ends of the slide member 76,, and the forces of which are utilized in conjunction with the area ratio of the large and small diameter portions 76′*a*, 76′*b* to produce the appropriate pilot pressure control effect upon the pressure regulator valve 86 and its return spring 77. FIG. 14 shows the performance characteristics of this third version of the hydromechanical fuel pump system of the present invention for controlling timing fluid pressure under full load and no load timing conditions.

Figure 15:
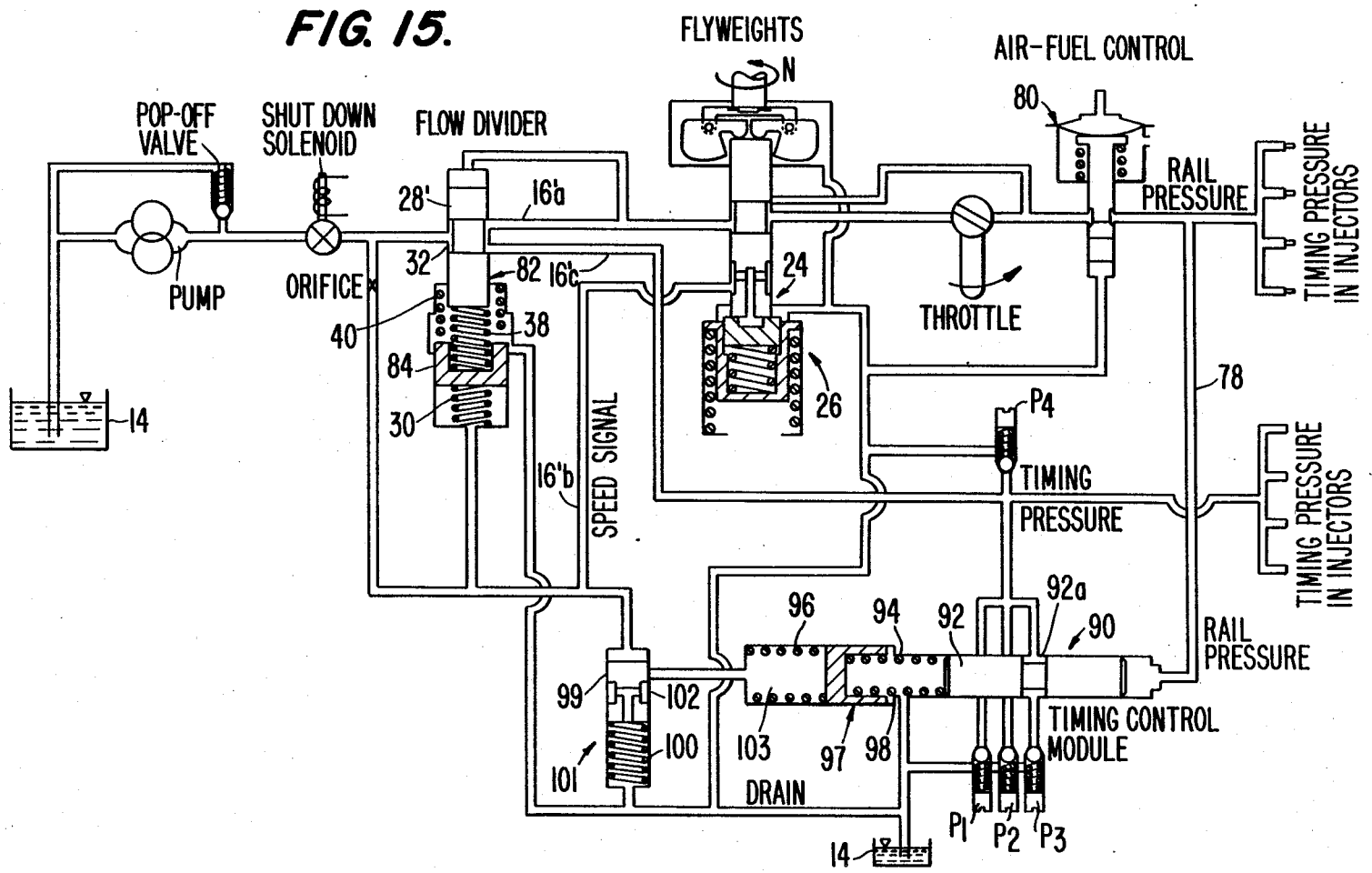
FIG. 15 illustrates a hydromechanical fuel pump where timing pressure is adjusted stepwise as a function of both engine speed and load in a modified manner relative to that of FIG. 11.

In FIG. 15, a pump system wherein the hydromechanical timing control aspect, like that of the embodiment described relative to FIG. 11, is designed to produce a stepwise adjustment of timing pressure as a function of both engine speed and load, but which differs from the FIG. 11 embodiment in a number of significant respects. Firstly, an air-fuel control valve 80 has been inserted downstream of the automotive throttle and engine speed governor, and more significantly, the torque shaping module has been combined with a flow divider into a flow divider/torque shaping module 82. The combined module 82 sets the pressure in passage 16′*a* as a function of engine speed via the speed signal pressure of the speed signal branch line 16′*b* as determined by the speed signal generator 24 (in which the generator has been constructed with the location of the governor spring and flyweights having been interchanged relative to their locations in FIG. 11).

In the module 82, a plunger 28′ is acted upon by the pressure spring 38 and the piston 84 (for acting upon the torque control spring 40 and supporting the pressure spring 38) interposed therebetween, as distinguished from torque shaping module 22 of FIG. 11. The force of spring 38 on piston 28′ is a function of the speed signal pressure against the area of piston 84, increased at low speeds by assist spring 30 and decreased at high speeds by torque control spring 40. The force of spring 38 is balanced by the pressure in line 16′*a* against the area of plunger 28′. Plunger 28′ regulates the pressure in 16′*a*, obtaining the same rail pressure vs. speed curve as show n in FIG. 4. Furthermore, to obtain the flow division function, the annular peripheral flow channel 32 is configured so that the upper and lower edges thereof will restrict flow to the fuel delivery branch 16′*a* or timing fluid supply branch line 16′*c* as plunger 28′ is shifted down or up, respectively, relative to the position shown in FIG. 15. Thus, the flow divider/torque shaping module 82 serves to divide the flow between the timing and injection sides via a single control valve with module 82 controlling pressure in branch 16′*a* and module 90 controlling pressure in branch 16′*c*.

Furthermore, because the flow divider valve arrangement of the combined flow divider/torque shaping module is a throttle valve, a pilot pressure generator and a timing pressure regulator servo, as utilized in the FIG. 11 embodiment, are no longer needed. Instead, a timing control module 90 is utilized which contains a slide member 92 which is shifted leftward relative to the position illustrated, by increases in rail pressure within the rail pressure line 78 as the pressure therein overcomes the force exerted by pressure balance springs 94. As slide member 92 is shifted, its annular peripheral recess communicates timing fluid branch line 16′*c* with a respective one of pressure valves $P_1$–$P_3$, each of which sets the pressure in timing fluid branch line 16′*c* at a different pressure level to thereby produce a stepwise change in timing pressure as a function of engine speed and load.

Additionally, by providing a fourth pressure valve $P_4$ connected between timing fluid branch 16'c and the reservoir 14, a fourth pressure step can be achieved that allows the dumping of excess pump flow beyond that achieved by the pressure valves of the timing control module. The force on spring 94, which along with rail pressure determines whether $P_1$, $P_2$, $P_3$, or $P_4$ is in effect is a function of engine speed. Speed switch assembly 101, shown in a transitional positin, subjects cavity 103 of module 90 to drain at low speed signal pressures because the force of spring 100 is greater than the force of the pressure of 16'b acting against the end area of plunger 99, allowing cavity 102 to communicate with cavity 103, and thus connecting cavity 103 to drain. Spring 94 then compresses spring 96 to lessen the force on spring 94. At high speed signal pressures spring 100 is compresssed so that speed signal pressure is introduced to cavity 103, pushing piston 97 against stop 98 and compressing spring 94. Thus at high speeds more rail pressure in passage 78 is required to move plunger 92 to the left.

It is also noted, relative to the construction of the flow divider/torque shaping module 82, that the need for the maximum timing pressure valve illustrated in FIG. 11 is dispensed with and the excess pump flow is dumped through these timing control valves. Otherwise, the engine torque curve shaping is produced in the same manner previously described relative to module 22.

While various embodiments have been shown and described in accordance with the present invention, it is to be understood that the same is not limited thereto, but is susceptible of numerous changes and modifications as known to those skilled in the art and, therefore, this invention should not be viewed as being limited to the details shown and described herein, but is intended to cover all such changes and modifications as are encompassed by the scope of the appended claims.

INDUSTRIAL APPLICABILITY

A hydromechanical fuel pump system in accordance with the present invention will find a wide variety of applications for fuel injection systems of internal combustion engines and is particularly suited for diesel engine systems. It provides a basic system for fuel supply delivery control that is precise, simple, and economical. Furthermore, without changes to the basic system, numerous different versions for controlling of the timing fluid supply are achievable. That is, timing can be achieved in a stepwise fashion as a function of engine speed and load conditions or it can be achieved in a continuous manner as a function of only engine speed or as a function of both engine speed and engine load.

We claim:

1. A hydromechanical fuel pump system for supplying timing fluid and fuel to high pressure fuel injectors comprising:

(a) a pump for withdrawing fuel from a fuel reservoir and delivering the fuel under pressure to a fuel line;

(b) a hydromechanical fuel control circuit means for interconnecting said fuel line to injector fuel supply rails for controlling the flow of fuel to said injectors, said fuel control circuit means comprising:

(1) a speed signal generator means for producing a fuel pressure in a speed signal branch line of said fuel control circuit that is a function of engine rpm;

(2) a torque shaping module, in a fuel delivery branch of said fuel control circuit, having means for receiving fuel flow from said fuel line and supplying it on through said fuel delivery branch line at a supply pressure corresponding to that of the fuel flow received by the torque shaping module in an initial operating range, for supplying the fuel received on through said fuel delivery branch line at a pressure that is a function of the fuel pressure in said speed signal branch line plus a pressure factor during a low speed engine operating range, for supplying the fuel received on through said fuel delivery branch line at a supply pressure that is a function of the fuel pressure in said speed signal branch line without said pressure factor during a middle engine operating range, and for supplying the fuel received on through said fuel delivery branch line at a supply pressure determined by partially offsetting the effect of the fuel pressure in said speed signal branch line by a counterpressure factor in a high speed engine operating range.

2. Fuel pump system according to claim 1, wherein said torque shaping module comprises a displaceable plunger that is acted upon by the fuel pressure in said speed signal branch line at one end and has bypass passage means for diverting a portion of the fuel received by the torque shaping module from the fuel line to the fuel reservoir; and wherein a spring biased valve means is provided for controlling opening and closing of said bypass passage means, said bypass valve means having a closure member that is acted upon by the force of a pressure spring in a direction toward said one end of the plunger in a manner causing said bypass passage means to open as a function of the difference between the force exerted by said pressure spring and that exerted upon the plunger by the fuel pressure in the fuel line, via a counterbore area of said bypass passage.

3. Fuel pump system according to claim 2, wherein said one end of the plunger is also acted upon by an assist spring only during an initial range of displacement of the plunger to produce said pressure factor; and wherein a torque control spring means is provided for acting upon said plunger in a direction toward said one end, only after said plunger has been displaced a predetermined distance, to produce said counterpressure factor.

4. Fuel pump system according to claim 3, wherein said bypass passage means has an outlet at an opposite end of the plunger from the end acted upon by the fuel pressure in the speed signal branch line; and wherein said bypass valve means is a button valve that is biased against the opposite end of the plunger by said pressure spring, opening of said bypass passage means also being a function of the ratio of the area of the end of the plunger acted upon by the pressure in said speed signal branch line to the area of the button valve against which said pressure spring acts.

5. Fuel pump system according to claim 4, wherein said speed signal generator means comprises flyweight means for producing a flyweight force that varies as a function of engine rpm, a button pop-off valve means, acted upon on opposite sides by fuel in said speed signal branch line and by said flyweight force, respectively, for regulating the fuel pressure in the speed signal branch line as a function of a ratio of the flyweight force relative to an area of said button pop-off valve means acted upon by the fuel in said speed signal branch line by allowing fuel therein to flow to said fuel reservoir; and wherein an orifice is provided in said speed signal branch line upstream of said torque shaping module relative to flow, from said pump, through said said button pop-off valve means to said fuel reservoir.

6. Fuel pump system according to claim 5, wherein a speed governor is provided downstream of said torque shaping module for setting at least idle and maximum engine speed fuel flow to the injectors.

7. Fuel pump system according to claim 6, wherein said speed governor is a minimum-maximum engine speed governor having a low idle port means for supplying fuel received from said torque shaping module to the fuel injectors via a fuel supply line that is in bypassing relationship to a fuel supply throttle to set a closed throttle engine idle speed, and a high speed port means for supplying fuel received from said torque shaping module to the fuel injectors via said fuel supply throttle to set a fully opened throttle, maximum engine speed.

8. Fuel pump system according to claim 7, wherein said speed governor is integrated into a single module with said speed signal generator and comprises an axially shiftable shaft that is acted upon at one end by said flyweight force and at an opposite end by a high speed spring and a low idle spring, the force of said low idle spring upon said shaft being matched to said flyweight force at a preset engine idling rpm and the force of said high speed spring being matched to said flyweight force at a preset maximum engine speed, whereby flow through said low idle port means is restricted, as said flyweight force exceeds that of said low idle spring, by resultant axial shifting of said shaft, and whereby flow through said high speed port means is restricted, as said flyweight force exceeds that of the high speed spring, by resultant axial shifting of said shaft.

9. Fuel pump system according to claim 6, wherein said speed governor is an all speed governor having a port means that is responsive to fuel throttle position for supplying fuel received from the torque shaping means to the injectors under all throttle conditions to provide governing at all engine speeds.

10. Fuel pump system according to claim 9, wherein said speed governor is integrated into a single module with said speed signal generator and comprises an axially shiftable shaft that is acted upon at one end by said flyweight force and at an opposite end by a high speed spring and a low idle spring, the force of said low idle spring upon said shaft being matched to said flyweight force at a preset engine idling rpm and the force of said high speed spring being matched to said flyweight force at a preset maximum engine speed, whereby flow through said port means is restricted, as said flyweight force exceeds that of said low idle spring, by resultant axial shifting of said shaft, and whereby flow through said port means is restricted, as said flyweight force exceeds that of the high speed spring, by resultant axial shifting of said shaft.

11. Fuel pump system according to claim 10, wherein said throttle is provided with cam means for controlling the force applied to the shaft by said spring as a function of throttle position.

12. Fuel pump system according to claim 1, wherein said speed signal generator means comprises flyweight means for producing a flyweight force that varies as a function of engine rpm, a button pop-off valve means, acted upon on opposite sides by fuel in said speed signal branch line and by said flyweight force, respectively, for regulating the fuel pressure in the speed signal branch line as a function of a ratio of the flyweight force relative to an area of said button pop-off valve means acted upon by the fuel in said speed signal branch line by allowing fuel therein to flow to said fuel reservoir; and wherein an orifice is provided in said speed signal branch line upstream of said torque shaping module relative to flow, from said pump, through said said button pop-off valve means to said fuel reservoir.

13. Fuel pump system according to claim 12, wherein a speed governor is provided downstream of said torque shaping module for setting at least idle and maximum engine speed fuel flow to the injectors.

14. Fuel pump system according to claim 13, wherein said speed governor is a minimum-maximum engine speed governor having a low idle port means for supplying fuel received from said torque shaping module to the fuel injectors via a fuel supply line that is in bypassing relationship to a fuel supply throttle to set a closed throttle engine idle speed, and a high speed port means for supplying fuel received from said torque shaping module to the fuel injectors via said fuel supply throttle to set a fully opened throttle, maximum engine speed.

15. Fuel pump system according to claim 14, wherein said speed governor is integrated into a single module with said speed signal generator and comprises an axially shiftable shaft that is acted upon at one end by said flyweight force and at an opposite end by a high speed spring and a low idle spring, the force of said low idle spring upon said shaft being matched to said flyweight force at a preset engine idling rpm and the force of said high speed spring being matched to said flyweight force at a preset maximum engine speed, whereby flow through said low idle port means is restricted, as said flyweight force exceeds that of said low idle spring, by resultant axial shifting of said shaft, and whereby flow through said high speed port means is restricted, as said flyweight force exceeds that of the high speed spring, by resultant axial shifting of said shaft.

16. Fuel pump system according to claim 13, wherein said speed governor is an all speed governor having a port means for supplying fuel received from the torque shaping module to the fuel injectors to set any governed engine speed responsive to throttle position.

17. Fuel pump system according to claim 16, wherein said speed governor is integrated into a single module with said speed signal generator and comprises an axially shiftable shaft that is acted upon at one end by said flyweight force and at an opposite end by a high speed spring and a low idle spring, the force of said low idle spring upon said shaft being matched to said flyweight force at a preset engine idling rpm and the force of said high speed spring being matched to said flyweight force at a preset maximum engine speed, whereby flow through said port means is restricted, as said flyweight force exceeds that of said low idle spring, by resultant axial shifting of said shaft, and whereby flow through said port means is restricted, as said flyweight force exceeds that of the high speed spring, by resultant axial shifting of said shaft.

18. Fuel pump system according to claim 1, wherein said throttle is provided with cam means for controlling the force applied to the shaft by said spring as a function of throttle position.

19. Fuel pump system according to claim 1, wherein a speed governor is provided downstream of said torque shaping module for setting at least idle and maximum engine speed fuel flow to the injectors.

20. Fuel pump system according to claim 1, further comprising a timing fluid supply means including a timing fluid supply branch line connected to said fuel line for delivering fuel from said pump to injection timing chambers of the fuel injectors, and a spring-biased piston regulator valve disposed in said fuel delivery branch.

21. Fuel pump system according to claim 20, wherein said regulator valve is arranged to function as a regulator means for maintaining a minimum timing fluid pressure in said timing fluid supply branch line.

22. Fuel pump system according to claim 21, wherein said speed signal generator means comprises flyweight means for producing a flyweight force that varies as a function of engine rpm, a button pop-off valve means, acted upon on opposite sides by fuel in said speed signal branch line and by said flyweight force, respectively, for regulating the fuel pressure in the speed signal branch line as a function of a ratio of the flyweight force relative to an area of said button pop-off valve means acted upon by the fuel in s said speed signal branch line by allowing fuel therein to flow to said fuel reservoir; wherein an orifice is provided in said speed signal branch line upstream of said torque shaping module relative to flow, from said pump, through said said button pop-off valve means to said fuel reservoir; and wherein said speed signal branch line is connected to said pump via a portion of said timing fluid supply branch line upstream of said orifice as a means for changing the timing fuel pressure as a function of engine speed.

23. Fuel pump system according to claim 20, wherein said speed signal generator means comprises flyweight means for producing a flyweight force that varies as a function of engine rpm, a button pop-off valve means, acted upon on opposite sides by fuel in said speed signal branch line and by said flyweight force, respectively, for regulating the fuel pressure in the speed signal branch line as a function of a ratio of the flyweight force relative to an area of said button pop-off valve means acted upon by the fuel in said speed signal branch line by allowing fuel therein to flow to said fuel reservoir; wherein an orifice is provided in said speed signal branch line upstream of said torque shaping module relative to flow, from said pump, through said said button pop-off valve means to said fuel reservoir; and wherein said speed signal branch line is connected to said pump via a portion of said timing fluid supply branch line upstream of said orifice as a means for changing the timing fuel pressure as a function of engine speed.

24. Fuel pump system according to claim 20, wherein said regulator valve is arranged to function as a regulator means for setting a maximum timing fluid pressure and wherein said fuel control circuit means includes control means for controlling timing fluid pressure as a function of engine speed and load.

25. Fuel pump system according to claim 24, wherein said control means comprises a timing signal pressure generator module means, responsive to fuel pressure in said speed signal branch line and to fuel pressure in said fuel supply rails, for producing a pilot pressure in a pilot line that is a function of engine speed and engine load, and a timing pressure regulator in said timing fluid supply branch line and responsive to the pilot pressure in said pilot line for adjusting timing fluid flow from said timing fluid supply branch line to the injectors.

26. A fuel pump system according to claim 25, wherein said timing signal pressure generator module comprises a servomechanism having a slide member, one end of which is exposed to the fuel pressure in said fuel supply rails and a second, opposite, end of which is exposed to fuel pressure in said speed signal branch line, and a plurality of pressure regulator valves, each of which has a pressure setting for opening that is different than that of the others, and wherein said servomechanism is interposed between said pressure regulator valves and said pilot line and is operable for individually interconnecting each of the pressure regulator valves with the pilot line in dependence upon the position of the slide member as determined by the net effect of the fuel pressures to which its first and second ends are exposed, whereby a stepwise adjustment of timing fluid pressure is achieved as a function of both engine speed and engine load.

27. Fuel pump system according to claim 26, wherein said speed signal generator means comprises flyweight means for producing a flyweight force that varies as a function of engine rpm, a button pop-off valve means, acted upon on opposite sides by fuel in said speed signal branch line and by said flyweight force, respectively, for regulating the fuel pressure in the speed signal branch line as a function of a ratio of the flyweight force relative to an area of said button pop-off valve means acted upon by the fuel in said speed signal branch line by allowing fuel therein to flow to said fuel reservoir; and wherein an orifice is provided in said speed signal branch line upstream of said torque shaping module relative to flow, from said pump, through said said button pop-off valve means to said fuel reservoir.

28. Fuel pump system according to claim 25, wherein said timing signal pressure generator module comprises a servomechanism having a slide member, one end of which is exposed to the fuel pressure in said fuel supply rails and a second, opposite, end of which is exposed to fuel pressure in said speed signal branch line, and a pressure regulator valve for opening an interconnection between said pilot line and said fuel reservoir when said pilot pressure exceeds a continuously adjustable valve opening pressure that is dependent upon the position of said slide member as determined as a function of the net effect of the fuel pressures to which its first and second ends are exposed, whereby a continuous adjustment of timing fluid pressure is achieved as a function of both engine speed and engine load.

29. Fuel pump system according to claim 28, wherein said speed signal generator means comprises flyweight means for producing a flyweight force that varies as a function of engine rpm, a button pop-off valve means, acted upon on opposite sides by fuel in said speed signal branch line and by said flyweight force, for regulating the fuel pressure in the speed signal branch line as a function of a ratio of the flyweight force relative to an area of said button pop-off valve means acted upon by the fuel is said speed signal branch line by allowing fuel therein to flow to said fuel reservoir, and an orifice in said speed signal branch line upstream of said torque shaping module relative to flow, from said pump, through said said button pop-off valve means to said fuel reservoir.

* * * * *